United States Patent [19]

Su

[11] Patent Number: 4,720,020

[45] Date of Patent: Jan. 19, 1988

[54] FOLDING CRATE

[76] Inventor: Kuo K. Su, No. 23, Lane 54, Sec. 2, An Ho Rd., Tainan City, Taiwan

[21] Appl. No.: 46,246

[22] Filed: May 4, 1987

[51] Int. Cl.[4] ..... B65D 7/24

[52] U.S. Cl. ..... 220/6; 220/1.5

[58] Field of Search ..... 220/6, 1.5, 19

[56] References Cited

U.S. PATENT DOCUMENTS

| | | | |
|---|---|---|---|
| 3,796,242 | 3/1974 | Sanders et al. | 220/6 |
| 3,870,185 | 3/1975 | Sanders et al. | 220/6 |
| 4,015,741 | 4/1977 | Frahm et al. | 220/6 |
| 4,081,099 | 3/1978 | Shead | 220/6 |
| 4,577,772 | 3/1986 | Bigliardi | 220/1.5 |
| 4,630,746 | 12/1986 | Fortenberry | 220/6 |

*Primary Examiner*—Steven M. Pollard

*Attorney, Agent, or Firm*—Poms, Smith, Lande & Rose

[57] ABSTRACT

A folding crate comprising a rectangular upper frame, two end walls, two upper side webs, two lower side webs, a base panel and, alternatively, a plurality of casters or supports and a belt. The upper side webs are foldable with respect to the upper frame and the lower side webs are foldable with respect to the base panel by forming a plurality of tubular lappings on the connecting face. Each pair of juxtaposed lappings is engaged together by a pin member.

3 Claims, 7 Drawing Figures

FOLDING CRATE

BACKGROUND OF THE INVENTION

The present invention relates generally to crates, and more particularly, to a folding crate which can be folded when not in use so as to minimize the required storage space.

Crates that cannot be folded occupy a larger space for storage even though not in use. In response to this problem, folding crates of varying sizes and shapes have been produced. As will be seen in the drawings, a conventional folding crate is usually manufactured by injection molding of plastic material and comprises an upper frame body A, a lower frame body B, and two end panels C, as appears most clearly in FIG. 5. Said upper frame body A comprises two longitudinal side webs D, and said lower frame body B comprises two longitudinal side webs E.

The conventional folding crate can be folded into a state as shown in FIG. 6.

The two longitudinal side webs D of the upper frame body A are foldable as having a linear V-shaped groove F in the inner portion thereof and the two longitudinal side webs E of the lower frame body B are foldable as having a linear V-shaped groove G in the inner portion thereof. This can be seen most clearly at the cutaway section shown in FIG. 7. However, these linear V-shaped grooves, F and G, turn to be the weakest part of the whole structure and may break easily after intensive utilization.

SUMMARY OF THE INVENTION

It is, therefore, a primary objective of the present invention to provide a folding crate having a stronger structure.

Another objective of the present invention is to provide a folding crate which make use of tubular lappings and pin members.

These and other objectives will become apparent from a careful reading of the description provided hereinafter, with appropriate reference to the attached drawings.

DETAILED DESCRIPTION OF THE PREFERRED EMBODIMENT

Figure 1:
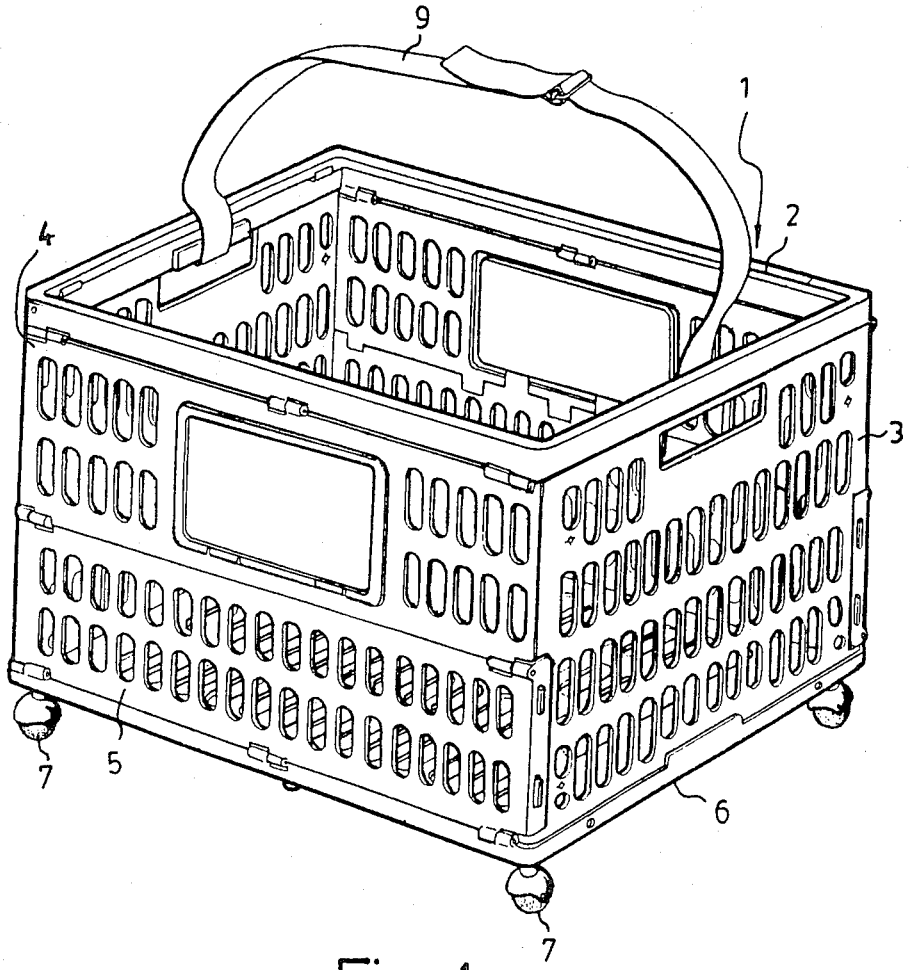
FIG. 1 is a perspective view of a folding crate in accordance with the present invention.

Referring first to FIG. 1, a folding crate in accordance with the present invention is shown generally by reference numeral 1. It can also be seen that the folding crate 1 has a symmetrical configuration and comprises a substantially rectangular upper frame 2, two transverse end walls 3, two longitudinal upper side webs 4, two longitudinal lower side webs 5, and a base panel 6. These walls, webs and panel are formed with a plurality of vertically, horizontally aligned, equally spaced holes. A plurality of casters 7 are, preferably, peripherally and detachably mounted on a lower face of the base panel 6, and more preferably, four to six casters 7 are mounted. Alternatively, a plurality of supports 8 (see FIG. 2) are, preferably, peripherally and detachably mounted on the lower face of said base panel 6 to take the place of casters. In addition, a belt 9 is, preferably, disposed on the two end walls 3 at the uppermost portion thereof.

Casters 7 are provided so as to facilitate the sliding movement of the folding crate 1 with respect to the floor. Supports 8 help to wedge the folding crate 1 into a lower folding crate 1 when a number of folding crates 1 are folded and stacked up. Thus, the existence of supports 9 helps to obviate the danger of collapse in a stack of folded crates 1. A belt 9 is provided so that the folding crate 1 can be handled more conveniently.

Figure 2:
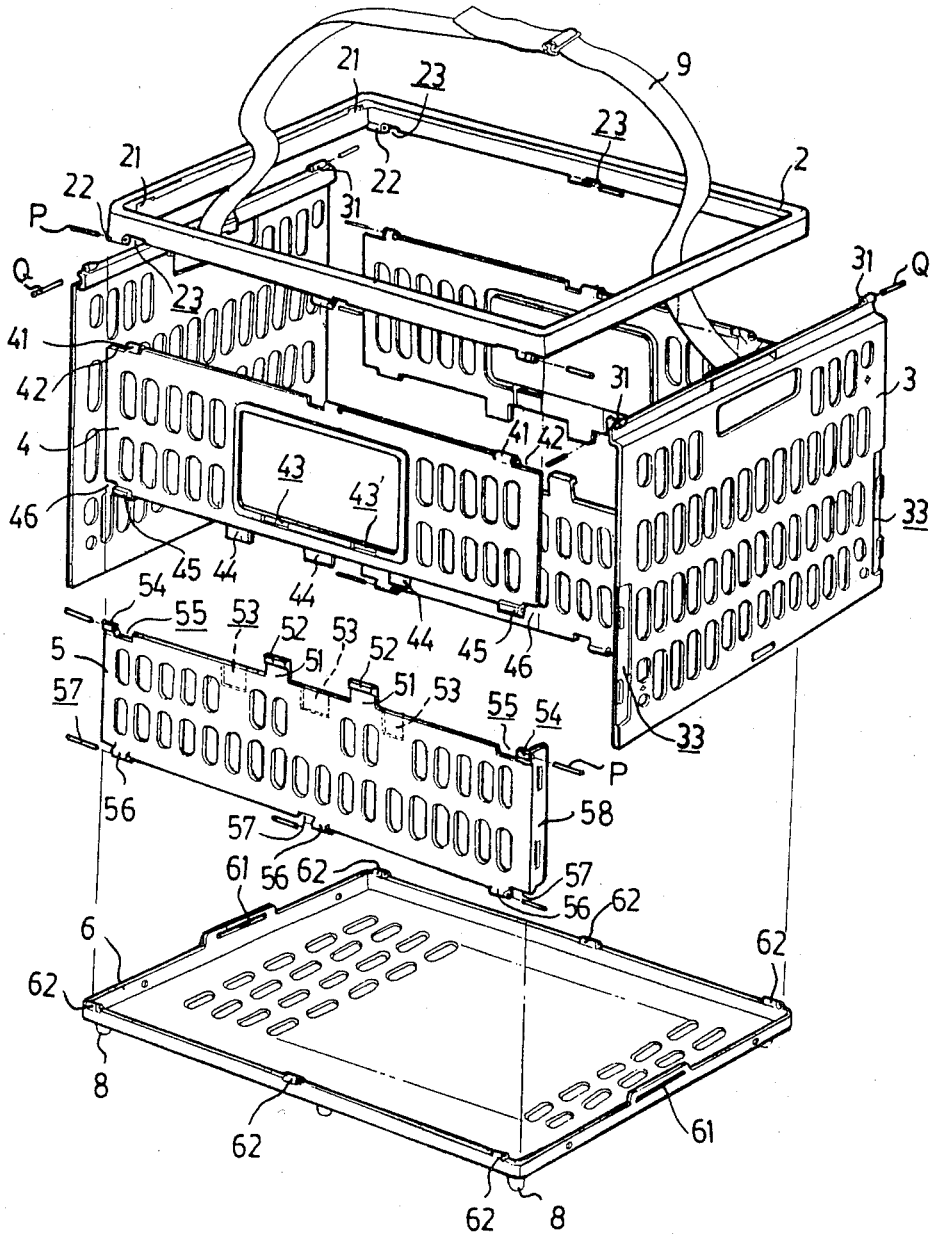
FIG. 2 is an exploded view of the folding crate illustrating the structure thereof.

Referring next to FIG. 2, it can be seen that the rectangular upper frame 2 includes two recesses 21 at an inner face of its transverse ends, and a plurality of first tubular lappings 22 at a lower face of its longitudinal sides with a third notch 23 formed adjacent to each of said first tubular lappings 22. Preferably, six of said first tubular lappings 22 are formed integrally with the upper frame 2, i.e., three of said first tubular lappings 22 are formed on each longitudinal side.

The two end walls 3 are engaged with the upper frame 2 at the transverse ends of said upper frame 2. Each of said end walls 3 includes two second tubular lappings 31 at an upper face thereof, a hanging means 32 at a central part of said upper face, and a shallow retainer 33 at an outer lower part of both edges thereof. Said shallow retainer 33 comprises two lengthened protruders on its outer face.

The two upper side webs 4 can also be seen in FIG. 2. Each of said upper side webs 4 includes a plurality of third tubular lappings 41 at an upper face thereof with a first notch 42 formed adjacent to each of said third tubular lappings 41, two rectangular slits 43 at a lower portion thereof, three rectangular prongs 44 extending downwardly from a lower face thereof, and a fourth tubular lapping 45 at both end parts of said lower face with a fifth notch 46 formed adjacent to each of said fourth tubular lappings 45. Preferably, six of said third tubular lappings 41 are formed integrally with the upper side webs 4, i.e., three of said third tubular lappings 41 are formed on each upper side web 4.

The two lower side webs 5 can also be seen in FIG. 2. Each of said lower side webs 5 includes two hooking tabs 51 having outwardly extending head portions 52 thereon extending upwardly from an upper face thereof, three rectangular retainers 53 formed externally on a upper part, a fifth tubular lapping 54 at both end parts of said upper face with a fourth notch 55 formed adjacent to each of said fifth tubular lappings 54, a plurality of sixth tubular lappings 56 at a lower face thereof with a seventh notch 57 formed adjacent to each of said sixth tubular lappings 56, and a bracket 58 extending laterally from the both ends thereof. Said bracket 58 comprises two lengthened openings on its face. Preferably, six of said sixth tubular lappings 56 are formed integrally with the lower side webs 5, i.e., three of said sixth tubular lappings 56 are formed on each lower side web 5.

A base panel 6, includes a bracket 61 extending from a central upper face of both transverse ends thereof, and a plurality of seventh tubular lappings 62 extending from an upper face of both longitudinal sides thereof. Preferably, six of said seventh tubular lappings 62 are formed integrally with the base panel 6, i.e., three of said seventh tubular lappings 62 are formed on each longitudinal side of the base panel 6.

Said first tubular lappings 22 are retained in the corresponding first notches 42, said third tubular lappings 41 are retained in the corresponding third notches 23, said fourth tubular lappings 45 are retained in the corresponding fourth notches 55, said fifth tubular lappings 54 are retained in the corresponding fifth notches 46, and said seventh tubular lappings 62 are retained in the corresponding seventh notches 57. Accordingly, said first tubular lappings 22 are juxtaposed with said third tubular lappings 41, said fourth tubular lappings 45 are juxtaposed with said fifth tubular lappings 54 and said sixth tubular lappings 56 are juxtaposed with said seventh tubular lappings 62, each pair of said juxtaposed lappings being engaged together by a pin member P.

Said second tubular lappings 31 are retained in the corresponding recesses 21 of the upper frame 2 with a resilient pin member Q to fix them together.

Said rectangular prongs 44 of the upper side webs 4 are retained in the corresponding rectangular retainers 53 of the lower side webs 5, and the outwardly extending head portions 52 of said hooking tabs 51 are retained in the corresponding rectangular slits 43 of the upper side webs 4.

A belt 9 is attached to the folding crate 1 at the hanging means 32 provided on the end walls 3.

Figure 3:
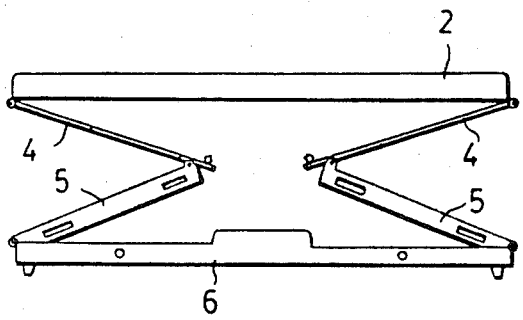
FIG. 3 is a side view illustrating a proper way to fold the folding crate.
Figure 4:
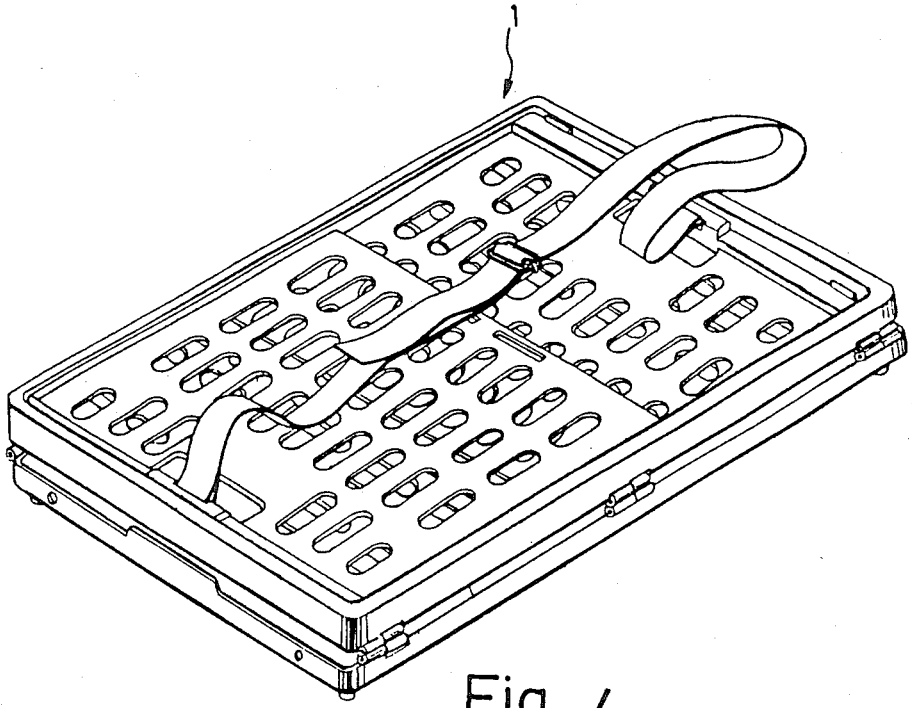
FIG. 4 is a perspective view of the folding crate in its folded state.
Figure 5:
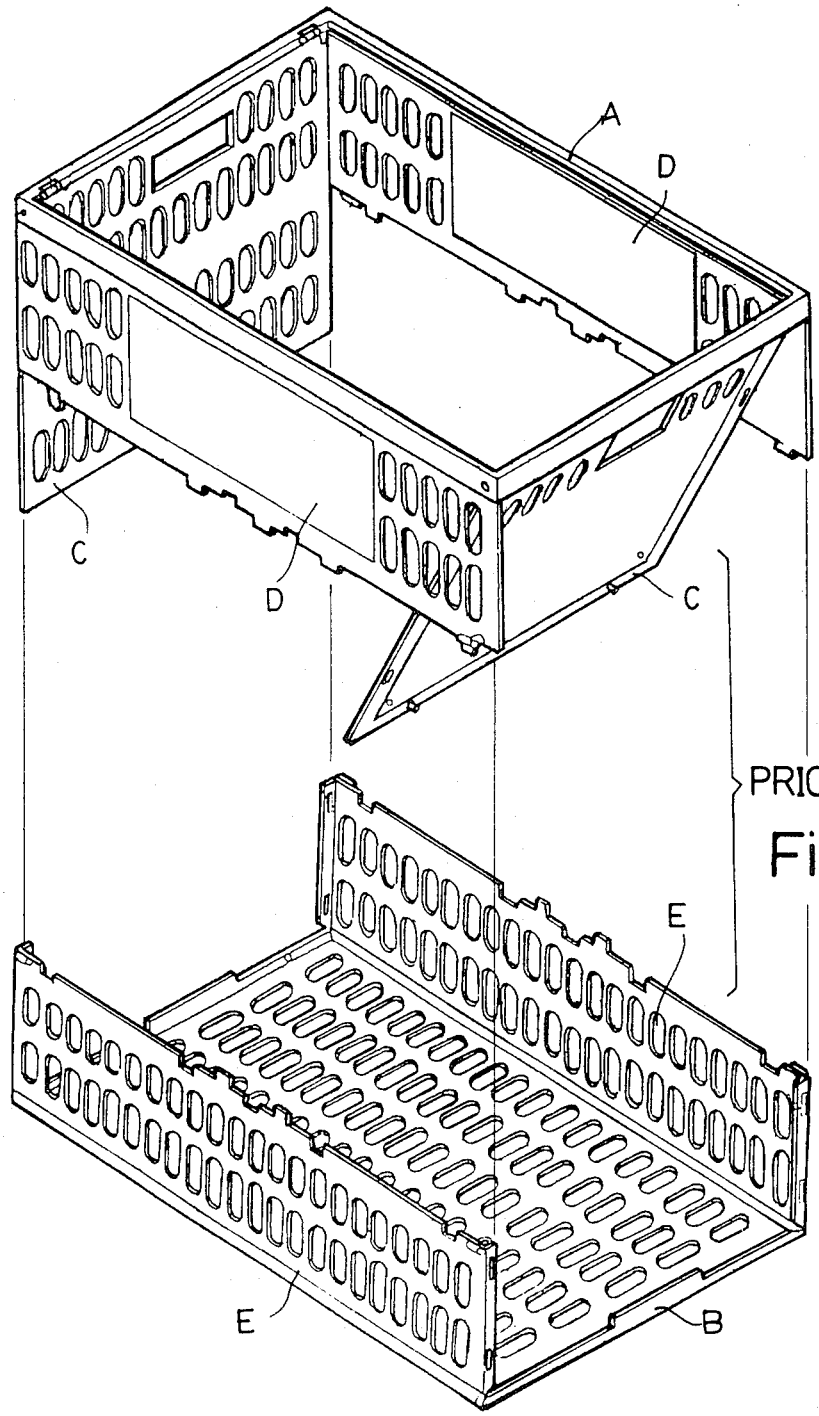
PRIOR ART Fig. 5.
FIG. 5 is an exploded view of a conventional folding crate illustrating the structure thereof.
Figure 6:
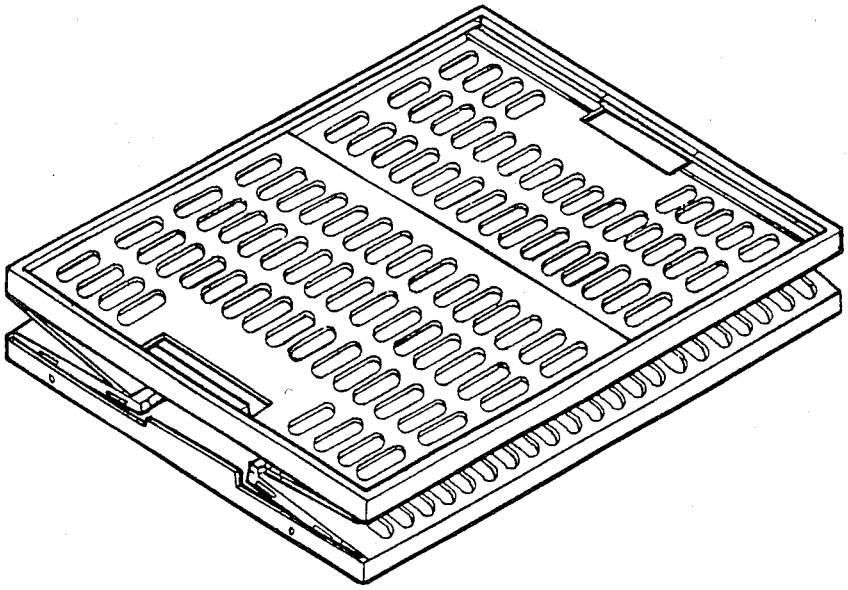
PRIOR ART Fig. 6.
FIG. 6 is a perspective view of the conventional folding crate in its folded state.
Figure 7:
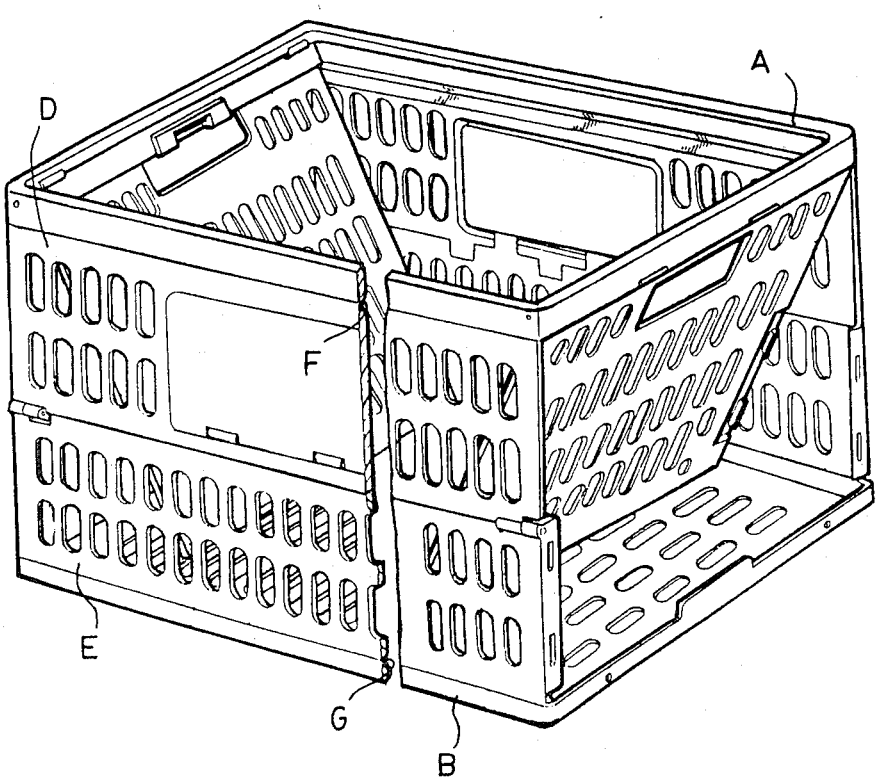
PRIOR ART Fig. 7
FIG. 7 is a perspective view of the conventional folding crate with a portion of which being cut away to show the sectional configuration thereof.

With particular reference to FIG. 3, the manner in which the crate 1 is folded will now be described in detail. Firstly, push the end walls 3 inwardly and upwardly, then press the upper and lower side webs 4 and 5 inwardly. Finally, press the whole structure downwardly and thus the whole article collapses down within seconds. To set up the crate 1, simply reverses the above-described sequence and the lengthened protruders provided on the shallow retainers 33 of the end walls 3 will plug into the lenghthened openings provided on the brackets 58 of the lower side webs 5.

While in accordance with the patent statutes, a best mode and preferred embodiment has been presented, the scope of the invention is not limited thereto, but rather by the scope of the invention.

I claim:

1. A folding crate comprising:

(a) a rectangular upper frame having two recesses at an inner face of its transverse ends, and a plurality of first tubular lappings at a lower face of said upper frame's longitudinal sides with a third notch formed adjacent to each of said first tubular lappings;

(b) two end walls, each of said end walls having two second tubular lappings at an upper face thereof, a hanging means at a central part of said upper face, and a shallow recess at an outer lower part of the two edges;

(c) two upper side webs, each having a plurality of third tubular lappings at an upper face thereof with a first notch formed adjacent to each of said third tubular lappings, two rectangular slits at a lower portion thereof, three rectangular prongs extending downwardly from a lower face thereof, and a fourth tubular lapping at two end parts of said lower face with a fifth notch formed adjacent to said fourth tubular lappings;

(d) two lower side webs, each having two hooking tabs with outwardly extending head portions extending upwardly from an upper face thereof, three rectangular retainers formed on said upper face, a fifth tubular lapping at both end parts of said upper face with a fourth notch formed adjacent to said fifth tubular lappings, a plurality of sixth tubular lappings at a lower face thereof with a seventh notch formed adjacent to each of said sixth tubular lappings, and a bracket extending laterally from the both ends thereof;

(e) a base panel having a bracket extending from a central upper face of both transverse ends thereof, and a plurality of seventh tubular lappings extending from an upper face of two longitudinal sides thereof; and (f) said first tubular lappings being retained in the corresponding first notches, said third tubular lappings being retained in the corresponding third notches, said fourth tubular lappings being retained in the corresponding fourth notches, said fifth tubular lappings being retained in the corresponding fifth notches, and said seventh tubular lappings being retained in the corresponding seventh notches, thereby causing said first tubular lappings to be juxtaposed with said third tubular lappings, said fourth tubular lappings to be juxtaposed with said fifth tubular lappings and said sixth tubular lappings to be juxtaposed with said seventh tubular lappings, each pair of juxtaposed lappings being engaged together by a pin member;

said second tubular lappings being retained in the corresponding recesses of upper frame with a resilient pin member to fix them together; and said rectangular prongs of the upper side webs being retained in the corresponding rectangular retainers of said lower side webs, and outwardly extending head portions of said hooking tabs being retained in said rectangular slits of said upper side webs.

2. A folding crate as set forth in claim 1, further comprising a plurality of casters peripherally and detachably mounted on a lower face of said base panel.

3. A folding crate as set forth in claim 1, further comprising a plurality of supports peripherally and detachably mounted on a lower face of said base panel.

* * * * *